US009534340B2

(12) United States Patent
Cavarretta et al.

(10) Patent No.: US 9,534,340 B2
(45) Date of Patent: Jan. 3, 2017

(54) CONTROLLING A LAUNDRY DRYER WITH A VARIABLE DRUM ROTATION SPEED AND A VARIABLE FAN ROTATION SPEED

(71) Applicant: Electrolux Home Products Corporation N.V., Brussels (BE)

(72) Inventors: Francesco Cavarretta, Pordenone (IT); Elena Pesavento, Porcia (IT); Maurizio Ugel, Fiume Veneto (IT)

(73) Assignee: Electrolux Home Products Corporation N.V., Brussels (BE)

( * ) Notice: Subject to any disclaimer, the term of this patent is extended or adjusted under 35 U.S.C. 154(b) by 37 days.

(21) Appl. No.: 14/647,245

(22) PCT Filed: Nov. 21, 2013

(86) PCT No.: PCT/EP2013/074392

§ 371 (c)(1),
(2) Date: May 26, 2015

(87) PCT Pub. No.: WO2014/079934

PCT Pub. Date: May 30, 2014

(65) Prior Publication Data

US 2015/0299934 A1 Oct. 22, 2015

(30) Foreign Application Priority Data

Nov. 26, 2012 (EP) ..... 12194169

(51) Int. Cl.
*D06F 58/12* (2006.01)
*D06F 58/28* (2006.01)
*D06F 58/20* (2006.01)

(52) U.S. Cl.
CPC ..... *D06F 58/28* (2013.01); *D06F 58/206* (2013.01); *D06F 2058/2806* (2013.01);
(Continued)

(58) Field of Classification Search
CPC ..... F26B 19/00; F26B 21/00; F26B 21/06; F26B 25/00; D06F 58/00; D06F 58/12; D06F 58/20
(Continued)

(56) References Cited

U.S. PATENT DOCUMENTS 3,702,030 A * 11/1972 Janke ..... D06B 1/00 34/498
4,231,166 A * 11/1980 McMillan ..... D06F 58/28 219/400
(Continued)

FOREIGN PATENT DOCUMENTS

BE EP 2733254 A1 * 5/2014 ..... D06F 58/28
BE WO 2014076159 A1 * 5/2014 ..... D06F 58/28
(Continued)

OTHER PUBLICATIONS

International Search Report mailed Apr. 8, 2014 in corresponding International Application No. PCT/EP2013/074392.
(Continued)

*Primary Examiner* — Stephen M Gravini
(74) *Attorney, Agent, or Firm* — Banner & Witcoff, LTD.

(57) ABSTRACT

A method is provided for controlling a laundry dryer including a laundry drum (12) with a variable drum rotation speed (vd) and a drying air stream fan (18) with a variable fan rotation speed (vf). The method includes the steps of setting a course of the drum rotation speed (vd) or a course of a drum motor power (Pd) of the laundry drum (12), and setting a fan rotation speed (vf) and/or a fan motor power (Pf) of the drying air stream fan (18) on the basis of the drum rotation speed (vd) and/or the drum motor power (Pd) of the laundry drum (12). The fan rotation speed (vf) and/or the fan motor power (Pf) of the drying air stream fan (18) is decreased with an increasing drum rotation speed (vd) and/or increasing drum motor power (Pd) of the laundry drum (12). The fan
(Continued)

rotation speed (vf) and/or the fan motor power (Pf) of the drying air stream fan (18) is increased with a decreasing drum rotation speed (vd) and/or decreasing drum motor power (Pd) of the laundry drum (12).

17 Claims, 6 Drawing Sheets

(52) U.S. Cl.
CPC ..... *D06F 2058/287* (2013.01); *D06F 2058/2854* (2013.01); *D06F 2058/2864* (2013.01)

(58) Field of Classification Search
USPC . 34/595, 601, 606, 610; 68/5 C, 5 R; 8/139, 8/149, 159
See application file for complete search history.

(56) References Cited

U.S. PATENT DOCUMENTS

| | | | | |
|---|---|---|---|---|
| 6,745,495 | B1 * | 6/2004 | Riddle | D06F 58/28 34/493 |
| 6,907,680 | B2 * | 6/2005 | Mariotti | D06F 58/28 34/486 |
| 7,146,749 | B2 * | 12/2006 | Barron | D06F 58/203 34/596 |
| 7,204,039 | B2 * | 4/2007 | Cho | D06F 58/24 34/596 |
| 7,322,123 | B2 * | 1/2008 | Tadano | D06F 58/206 34/77 |
| 8,156,660 | B2 * | 4/2012 | Carow | D06F 58/26 200/16 R |
| 8,387,273 | B2 * | 3/2013 | Driussi | D06F 58/206 165/11.1 |
| 8,627,581 | B2 * | 1/2014 | Brown | D06F 58/02 34/603 |
| 8,667,702 | B2 * | 3/2014 | Ediger | D06F 58/28 165/58 |
| 8,919,009 | B2 * | 12/2014 | Colombo | D06F 58/28 34/413 |
| 9,146,056 | B2 * | 9/2015 | Lee | F26B 21/086 |
| 9,356,542 | B2 * | 5/2016 | Ragogna | D06F 58/206 |
| 9,372,031 | B2 * | 6/2016 | Contarini | D06F 58/206 |
| 2007/0251118 | A1 * | 11/2007 | Doh | D06F 58/28 34/528 |
| 2012/0174430 | A1 | 7/2012 | Kim et al. | |
| 2012/0186305 | A1 | 7/2012 | Taniguchi et al. | |
| 2015/0299934 | A1 * | 10/2015 | Cavarretta | D06F 58/28 34/282 |
| 2015/0322619 | A1 * | 11/2015 | Bison | D06F 58/28 34/487 |

FOREIGN PATENT DOCUMENTS

| | | | |
|---|---|---|---|
| DE | 102011005164 | A1 | 9/2012 |
| EP | 1688532 | A2 | 8/2006 |
| EP | 2221412 | A1 | 8/2010 |
| EP | 2281935 | A1 | 2/2011 |

OTHER PUBLICATIONS

International Search Report mailed Apr. 30, 2014 in related International Application No. PCT/EP2013/074042.

* cited by examiner

CONTROLLING A LAUNDRY DRYER WITH A VARIABLE DRUM ROTATION SPEED AND A VARIABLE FAN ROTATION SPEED

BACKGROUND

The present invention relates to a method for controlling a laundry dryer with a variable drum rotation speed and a variable fan rotation speed. Further, the present invention relates to a corresponding laundry dryer.

The drum rotation speed in a laundry dryer is often constant during the drying cycle. Sometimes a variation of the drum rotation speed is used to optimize the drying performance. The drum rotation speed may be changed on the basis of many different situations. For example, a program for laundry made of wool requires a drum rotation speed higher than the usual drum rotation speed. In the wool cycle the higher drum rotation speed allows to stack the laundry around the wall of the laundry drum, so that damages to the laundry are avoided. Also in the case of laundry made of synthetic materials the drum rotation speed may be different. Further, during a specific drying cycle the drum rotation speed may change, for example due to inversions or to drum movement required to un-tangle possible knots in the laundry.

Any change to the drum rotation speed may have a not negligible impact into the overall machine performances. The drying cycle is usually negatively affected when the laundry drum is not rotating at a standard speed for which the drying performances are maximized. However, as mentioned a above, variations of the drum speed from the standard speed are possible to meet different laundry drying requirements In particular, the variation of the drum rotation speed in a laundry dryer with a heat pump system disturbs the overall performances of the laundry dryer.

SUMMARY OF SELECTED INVENTIVE ASPECTS

It is an object of the present invention to provide a method for controlling a laundry dryer with a variable drum rotation speed in order to avoid or mitigate the above mentioned problems, wherein said method improves both energy performance and cycle time. It is further an object of the present invention to provide a corresponding laundry dryer.

In an aspect, a method is provided for controlling a laundry dryer including a laundry drum with a variable drum rotation speed and a drying air stream fan with a variable fan rotation speed, said method comprising the steps of:

- setting a course of the drum rotation speed or a course of a drum motor power of the laundry drum, and
- setting a fan rotation speed and/or a fan motor power of the drying air stream fan on the basis of the drum rotation speed and/or the drum motor power of the laundry drum,
- wherein the fan rotation speed and/or the fan motor power of the drying air stream fan is decreased with an increasing drum rotation speed and/or increasing drum motor power of the laundry drum,
- and wherein the fan rotation speed and/or the fan motor power of the drying air stream fan is increased with a decreasing drum rotation speed and/or decreasing drum motor power of the laundry drum.

A main idea of the present invention is the adaption of the fan rotation speed and/or the fan motor power of the drying air stream fan to the drum rotation speed and/or drum motor power of the laundry drum in order to maximise the drying performance despite variations of the drum speed during the drying cycle and at the same time to maintain the energy consumption associated to the drum motor and fan motor within a predetermined level.

Particularly the applicant has found that when the drum speed decreases (due to different reasons) a proper increase of the fan rotation speed recovers an expected drying performance without exceeding a predetermined overall energy consumption. In fact it has been found that an increased level of the fan rotation speed compensates for the decreased drum rotation speed in term of drying efficiency so that the overall drying performance are kept close to a maximized level and at the same time the energy consumption due to the drum motor and fan motor are maintained within a reasonable range.

An increased fan rotation speed generates an higher flow rate of the drying air stream, which improves the drying efficiency. It has been found that in the case of a laundry dryer having a heat pump system including a compressor, an evaporator, a condenser, and expansion means, the increase of energy consumption due to the increased fan rotation speed is more than compensated by the energy consumption decrease at the compressor of the heat pump system. The higher drying air stream generated by the increased fan rotation speed improves the heat exchange at the condenser and evaporator which results in a lower compressor working level.

Preferably, according to the present invention, the course (profile speed over time, pattern speed over time) of the drum rotation speed or the course of the drum motor power of the laundry drum is set according to a program selected by a user, and/or according to an input by the user, and/or according to an estimated/detected amount of laundry in the laundry drum.

In practise the pattern of the speed/power of the laundry drum over time changes in response to the selection made by the user and/or in response to input by the user, particularly textile to be dried, initial humidity of the clothes, final humidity of the clothes to be achieved at the end of the drying cycle, drum movement for anti-wrinkling option.

Further, the pattern of the speed/power of the laundry drum over time changes in response to an estimated/detected amount of laundry in the laundry drum.

In particular, the fan rotation speed of the drying air stream fan decreases linearly with increasing drum rotation speed of the laundry drum.

According to another example, the fan motor power of the drying air stream fan decreases linearly with increasing drum motor power of the laundry drum.

Further, the fan rotation speed of the drying air stream fan may decrease linearly with increasing drum motor power of the laundry drum.

In a similar way, the fan motor power of the drying air stream fan may decrease linearly with increasing drum rotation speed of the laundry drum.

Preferably, a predetermined threshold value of the drum rotation speed is defined and if the drum rotation speed is lower than the threshold value, then the fan rotation speed is set to a first fan rotation speed value, differently if the drum rotation speed is higher than the threshold value, then the fan rotation speed is set to a second fan rotation speed value. The first fan rotation speed value is higher than the second fan rotation speed value.

Preferably, the fan rotation speed of the drying air or the fan motor power of the drying air stream decreases step-wise with increasing drum rotation speed of the laundry drum or with increasing drum motor power of the laundry drum.

In particular, the method is provided for a laundry dryer with a heat pump system, wherein a rotation speed and/or a power of a compressor is controlled in dependence of the fan rotation speed of the drying air stream fan.

In this case, the rotation speed or power of the compressor may increase with increasing fan rotation speed of the drying air stream fan.

For example, the drum rotation speed of the laundry drum is variable between 10 rpm and 70 rpm, in particular between 20 rpm and 60 rpm.

The fan rotation speed of the drying air stream fan may be variable between 2000 rpm and 4000 rpm, in particular between 2700 rpm and 3500 rpm.

In another aspect, a laundry dryer includes a laundry drum driven by a drum motor and a drying air stream fan driven by a fan motor, wherein the drum motor and the fan motor are controlled or controllable independently from each other by a control unit, and wherein the laundry dryer is provided for the method mentioned above.

Since the drum motor and the fan motor are controlled or controllable independently from each other, the method can easily be realized by such a laundry drum.

For example, the laundry dryer comprises an air stream circuit driven by the drying air stream fan.

In particular, the laundry dryer comprises a heat pump system, wherein a rotation speed and/or a power of a compressor are controlled or controllable by the control unit.

Preferably, the rotation speed or power of the compressor increases with increasing fan rotation speed of the drying air stream fan.

Further, the laundry dryer may comprise an air-to-air heat exchanger thermally interconnected between the air stream circuit of the laundry dryer and ambient air.

At last, the air-to-air heat exchanger may correspond with at least one ambient air fan controlled or controllable by the control unit.

Novel and inventive features believed to be the characteristic of the present invention are set forth in the appended claims.

BRIEF DESCRIPTION OF THE DRAWINGS

The invention will be described in further detail with reference to the drawings, in which.

DETAILED DESCRIPTION OF EXAMPLE EMBODIMENTS

Figure 1:
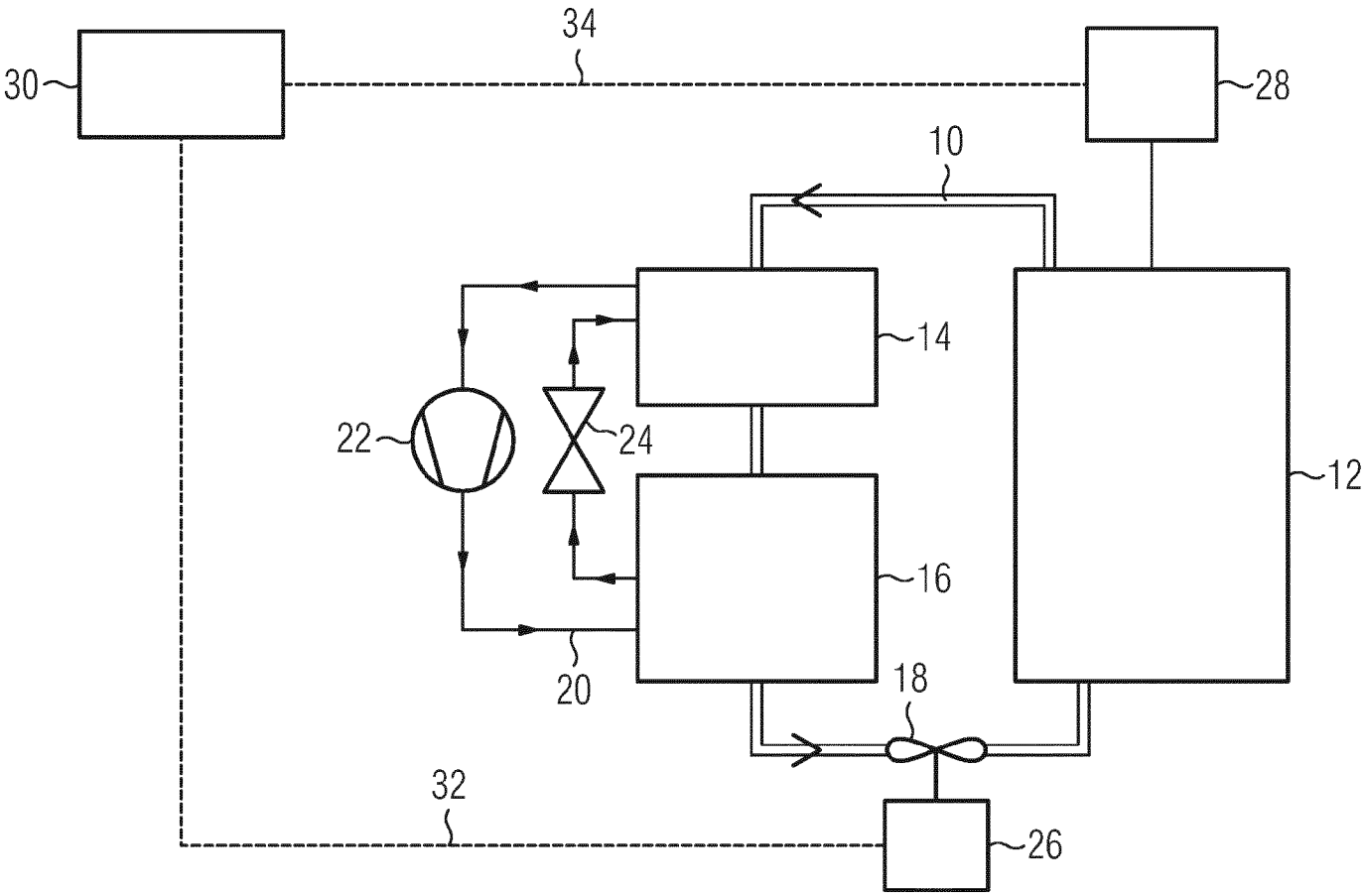
FIG. 1 illustrates a schematic diagram of a laundry dryer with a heat pump system according to a first embodiment of the present invention.

FIG. 1 illustrates a schematic diagram of a laundry dryer with a heat pump system according to a first embodiment of the present invention.

The heat pump system comprises an air stream circuit 10, preferably closed, and a closed refrigerant circuit 20. The air stream circuit 10 is formed by a laundry treatment chamber 12, preferably a rotatable drum, an evaporator 14, a condenser 16 and a drying air stream fan 18. The refrigerant circuit 20 is formed by a compressor 22, the condenser 16, an expansion device 24 and the evaporator 14. For example, the expansion device 24 is an expansion valve. The evaporator 14 and the condenser 16 are heat exchangers and form thermal interconnections between the air stream circuit 10 and the refrigerant circuit 20.

For specific type of refrigerant, for example Carbon Dioxide, the heat pump system can work at least at the critical pressure of refrigerant without change of phase, and in this case the evaporator is a gas heater and the condenser is a gas cooler.

The drying air stream fan 18 is driven by a fan motor 26. The laundry drum 12 is driven by a drum motor 28. The fan motor 26 and the drum motor 28 are controlled by a control unit 30. The fan motor 26 is connected to the control unit 30 by a fan control line 32. The drum motor 28 is connected to the control unit 30 by a drum control line 34.

In the air stream circuit 10, the evaporator 14 cools down and dehumidifies the air stream, after the warm and humid air stream has passed the laundry drum 12. Then, the condenser 16 heats up the air stream, before the air stream is re-inserted into the laundry drum 12 again. The air stream is driven by the drying air stream fan 18 arranged between the condenser 16 and the laundry drum 12. In the refrigerant circuit 20, a refrigerant is compressed and heated up by the compressor 22, cooled down and condensed in the condenser 16, expanded in the expansion device 24, then vaporised and heated up in the evaporator 14.

The control unit 30 controls a fan rotation speed vf and/or a fan motor power Pf of the drying air stream fan 18 via the fan control line 32. In a similar way, the control unit 30 controls a drum rotation speed vd and/or a drum motor power Pd of the laundry drum 12 via the drum control line 34. The fan rotation speed vf and/or the fan motor power Pf are controlled on the basis of the drum rotation speed vd and/or the drum motor power Pd according to an empirical relation (which the applicant has found by tests) depending on the characteristics of the heat pump system and the air stream circuit. Said empirical relations between the fan rotation speed vf and fan motor power Pf on the one hand and the drum rotation speed vd and drum motor power Pd on the other hand assures that the drying efficiency of the laundry dryer is maintained with minimum energy consumption. In general, one or more parameters related to the rotation of the drying air stream fan 18 are controlled on the bases of one or more parameters related to the rotation of the laundry drum 12.

Figure 2:
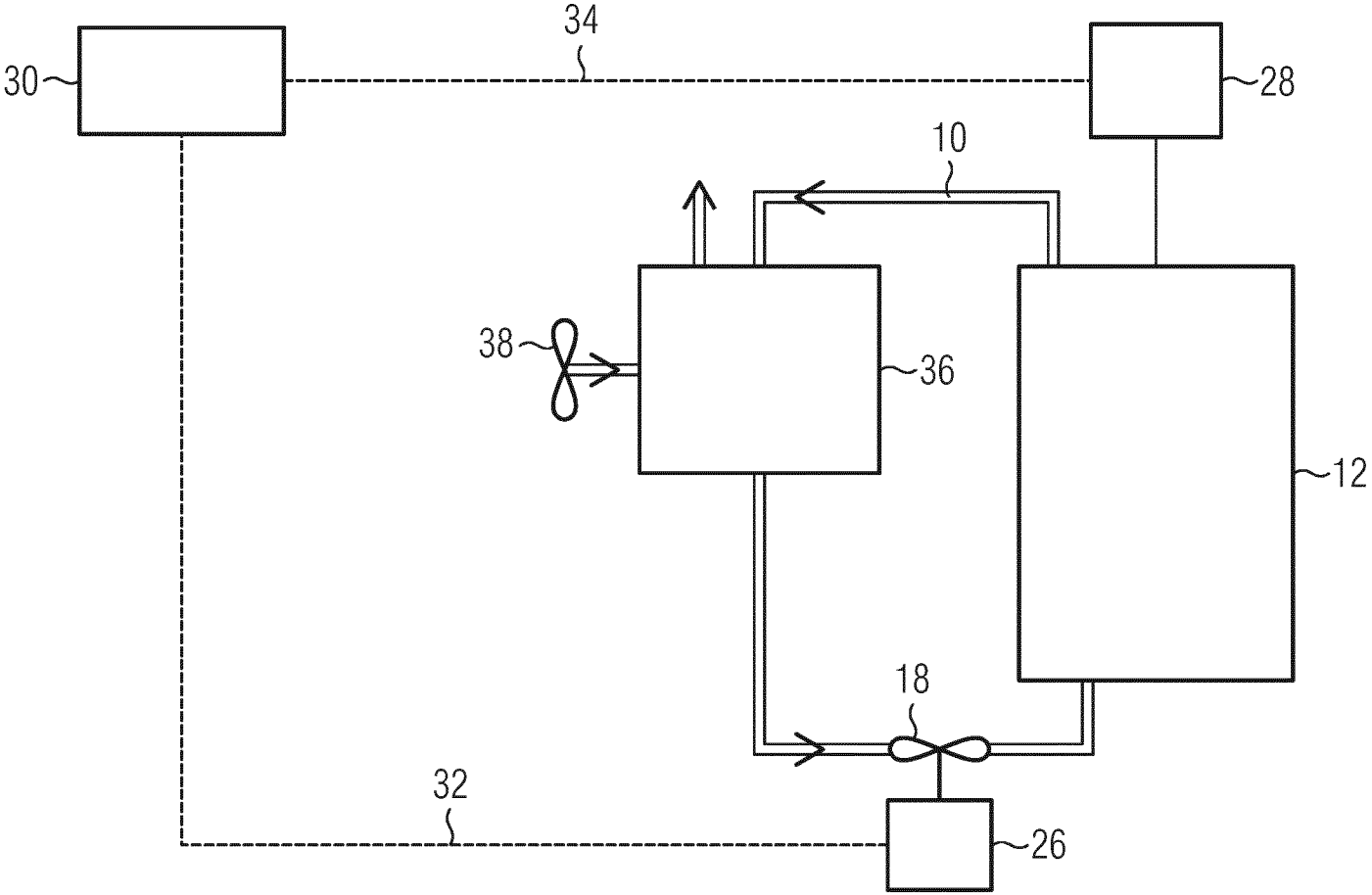
FIG. 2 illustrates a schematic diagram of the laundry dryer with an air-to-air condenser according to a second embodiment of the present invention.

FIG. 2 illustrates a schematic diagram of the laundry dryer with an air-to-air condenser 36 according to a second embodiment of the present invention.

The laundry dryer comprises the closed air stream circuit 10. The air stream circuit 10 of the second embodiment is formed by the laundry drum 12, the air-to-air condenser 36, the drying air stream fan 18 and an ambient air fan 38. The air-to-air condenser 36 is an air-to-air heat exchanger and forms a thermal interconnection between the air stream circuit 10 and the ambient air. The air-to-air condenser 36 includes two separate channels. A first channel is provided for the air stream of the air stream circuit 10. A second channel is provided for the ambient air. The ambient air is blown through the second channel by the ambient air fan 38.

The drying air stream fan 18 is driven by the fan motor 26. The laundry drum 12 is driven by the drum motor 28. The fan motor 26 and the drum motor 28 are controlled by the control unit 30. The fan motor 26 is connected to the control unit 30 by the fan control line 32. In a similar way, the drum motor 28 is connected to the control unit 30 by the drum control line 34.

The air-to-air condenser 36 cools down and dehumidifies the air stream by ambient air, after the warm and humid air stream has passed the laundry drum 12. Then, the air stream is heated up by a heating device, for example by an electric heating element, before the air stream is re-inserted into the laundry drum 12 again. Said heating device is not shown. The air stream is driven by the drying air stream fan 18 arranged between the air-to air condenser 36 and the laundry drum 12.

The control unit 30 controls the fan rotation speed vf and/or the fan motor power Pf of the drying air stream fan 18 via the fan control line 32. Further, the control unit 30 controls the drum rotation speed vd and/or the drum mofor power Pd of the laundry drum 12 via the drum control line 34. The fan rotation speed vf and/or the fan motor power Pf are controlled on the basis of the drum rotation speed vd and/or the drum motor power Pd according to an empirical relation depending on the characteristics of the laundry dryer, particularly the air stream circuit. The empirical relation between the fan rotation speed vf and fan motor power Pf on the one hand and the drum rotation speed vd and/or the drum motor power Pd on the other hand assures that a predetermined energy consumption is not exceeded and the drying efficiency of the laundry dryer is maintained. In general, one or more parameters related to the rotation of the drying air stream fan 18 are controlled on the bases of one or more parameters related to the rotation of the laundry drum 12.

The following diagrams in FIG. 3 to FIG. 6 show examples of correlations between the fan rotation speed vf or the fan motor power Pf on the one hand and the drum rotation speed vd or the drum motor power Pd on the other hand.

Figure 3:
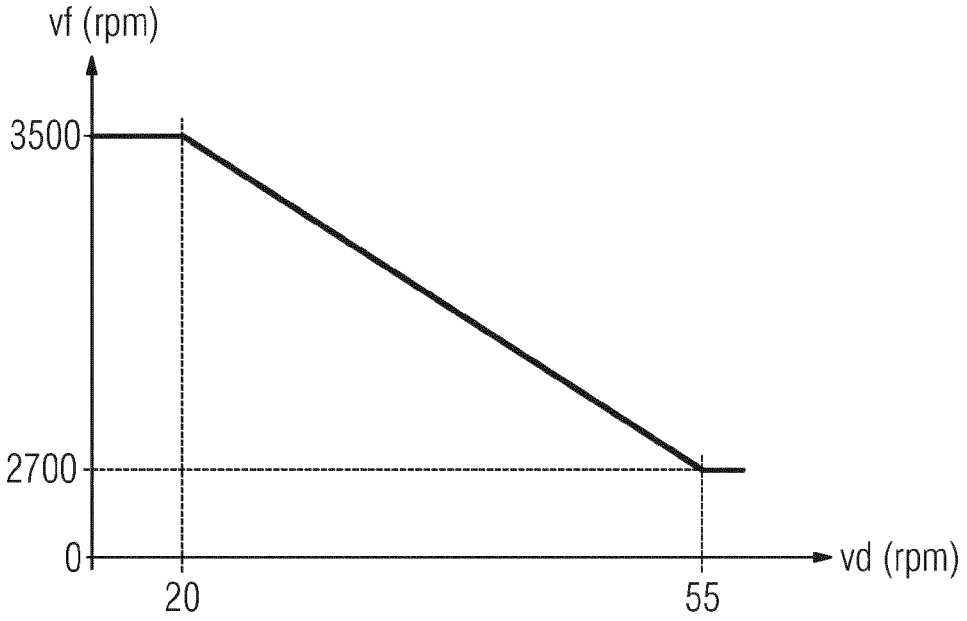
FIG. 3 illustrates a schematic diagram of the correlation between a fan rotation speed and a drum rotation speed according to the present invention.

FIG. 3 illustrates a schematic diagram of the correlation between the fan rotation speed vf and the drum rotation speed vd according to the present invention. The fan rotation speed vf decreases with an increasing drum rotation speed vd. In this example, the fan rotation speed vf decreases linearly from 3500 rpm to 2700 rpm, while the drum rotation speed vd increases from 20 rpm to 50 rpm.

The following table shows this example of the correlation between the fan rotation speed vf and the drum rotation speed vd:

| drum rotation speed vd: | fan rotation speed vf: |
|---|---|
| ≥55 rpm | 2700 rpm |
| 55 rpm to 50 rpm | 2800 rpm |
| 50 rpm to 45 rpm | 2920 rpm |
| 45 rpm to 40 rpm | 3040 rpm |
| 40 rpm to 35 rpm | 3170 rpm |
| 35 rpm to 30 rpm | 3300 rpm |
| 30 rpm to 25 rpm | 3400 rpm |
| ≤25 rpm | 3500 rpm |

Similarly, the diagram shown in FIG. 3 represents a linear relationship between the drum rotation speed vd and the fan rotation speed vf.

Figure 4:
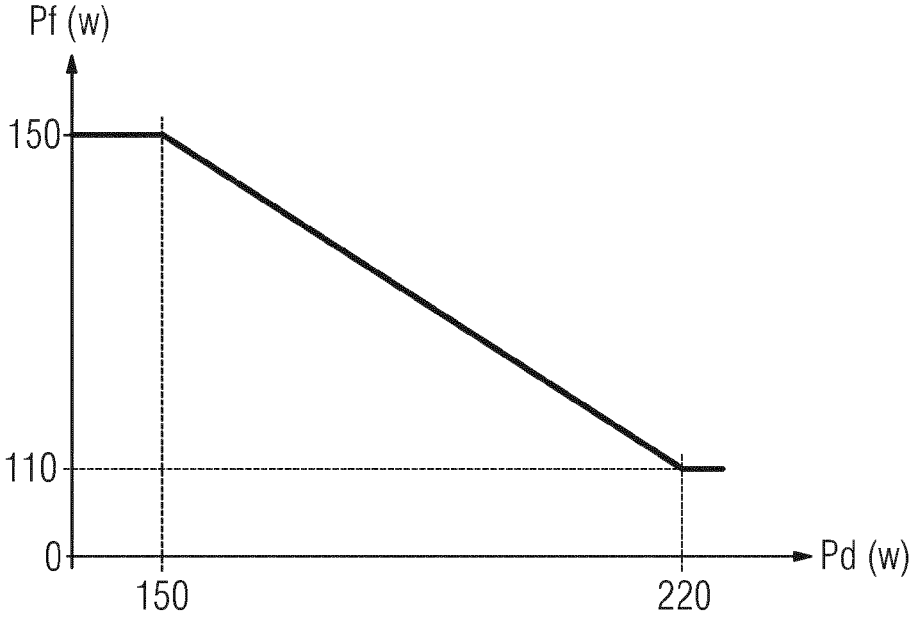
FIG. 4 illustrates a schematic diagram of the correlation between a fan motor power and a drum motor power according to the present invention.

FIG. 4 illustrates a schematic diagram of the correlation between a fan motor power and a drum motor power according to the present invention. The fan motor power Pf decreases with an increasing drum motor power Pd. In this example, the fan motor power Pf decreases linearly from 150 W to 110 W, while the drum motor power Pd increases from 150 W to 220 W.

The following table shows this example of the correlation between the drum motor power Pd and the fan motor power Pf:

| drum motor power Pd: | fan motor power Pf: |
|---|---|
| ≥220 W | 110 W |
| 220 W to 210 W | 115 W |
| 210 W to 200 W | 120 W |
| 200 W to 190 W | 125 W |
| 190 W to 180 W | 130 W |
| 180 W to 170 W | 135 W |
| 170 W to 160 W | 140 W |
| ≤160 W | 150 W |

Similarly, the diagram shown in FIG. 4 represents a linear relationship between the drum motor power Pd and the fan motor power Pf.

Figure 5:
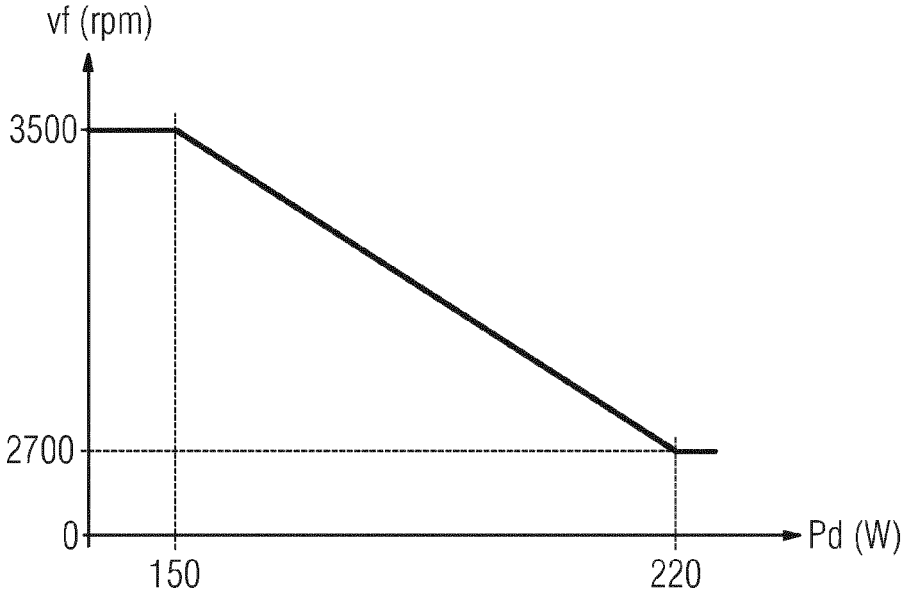
FIG. 5 illustrates a schematic diagram of the correlation between the fan rotation speed and the drum motor power according to the present invention.

FIG. 5 illustrates a schematic diagram of the correlation between the fan rotation speed vf and the drum motor power Pd according to the present invention. The fan rotation speed vf decreases with an increasing drum motor power Pd. In this example, the fan rotation speed vf decreases linearly from 3500 rpm to 2700 rpm, while the drum motor power Pd increases from 150 W to 220 W.

The following table shows the example of the correlation between the drum motor power Pd and the fan rotation speed vf:

| drum motor power Pd: | fan rotation speed vf: |
|---|---|
| ≥220 W | 2700 rpm |
| 220 W to 210 W | 2800 rpm |
| 210 W to 200 W | 2920 rpm |
| 200 W to 190 W | 3040 rpm |
| 190 W to 180 W | 3170 rpm |
| 180 W to 170 W | 3300 rpm |
| 170 W to 160 W | 3400 rpm |
| ≤160 W | 3500 rpm |

Similarly, the diagram shown in FIG. 5 represents a linear relationship between the drum motor power Pd and the fan rotation speed vf.

Figure 6:
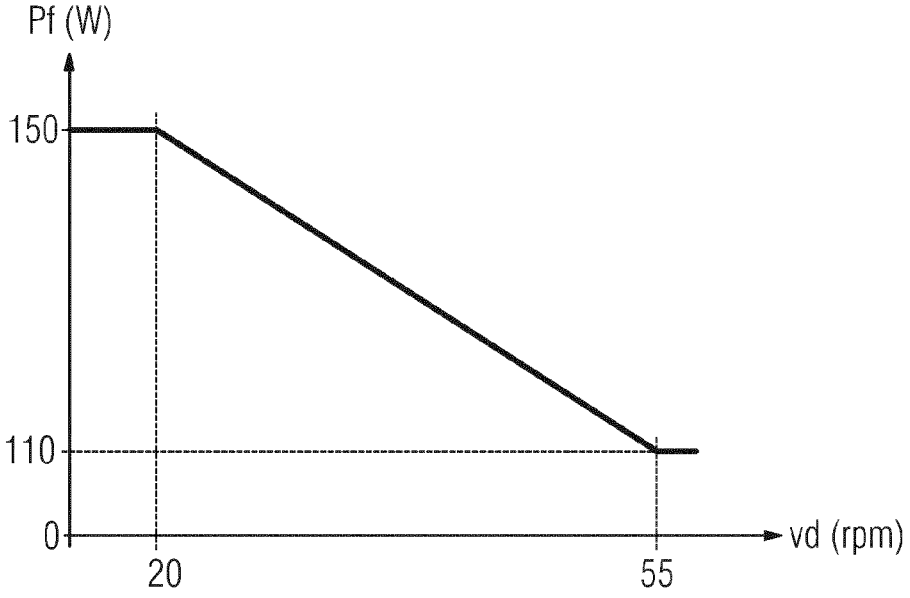
FIG. 6 illustrates a schematic diagram of the correlation between the fan motor power and the drum rotation speed according to the present invention.

FIG. 6 illustrates a schematic diagram of the correlation between the fan motor power Pf and the drum rotation speed vd according to the present invention. The fan motor power Pf decreases with an increasing drum rotation speed vd. In this example, the fan motor power Pf decreases linearly from 150 W to 110 W, while the drum rotation speed vd increases from 20 rpm to 55 rpm.

The following table shows the example of the correlation between the drum motor power Pd and the fan motor power Pf:

| drum rotation speed vd: | fan motor power Pf: |
|---|---|
| ≥55 rpm | 110 W |
| 55 rpm to 50 rpm | 115 W |
| 50 rpm to 45 rpm | 120 W |
| 45 rpm to 40 rpm | 125 W |
| 40 rpm to 35 rpm | 130 W |
| 35 rpm to 30 rpm | 135 W |
| 30 rpm to 25 rpm | 140 W |
| ≤25 rpm | 150 W |

Similarly, the diagram shown in FIG. 6 represents a linear relationship between the drum rotation speed vd and the fan motor power Pf.

Figure 7:
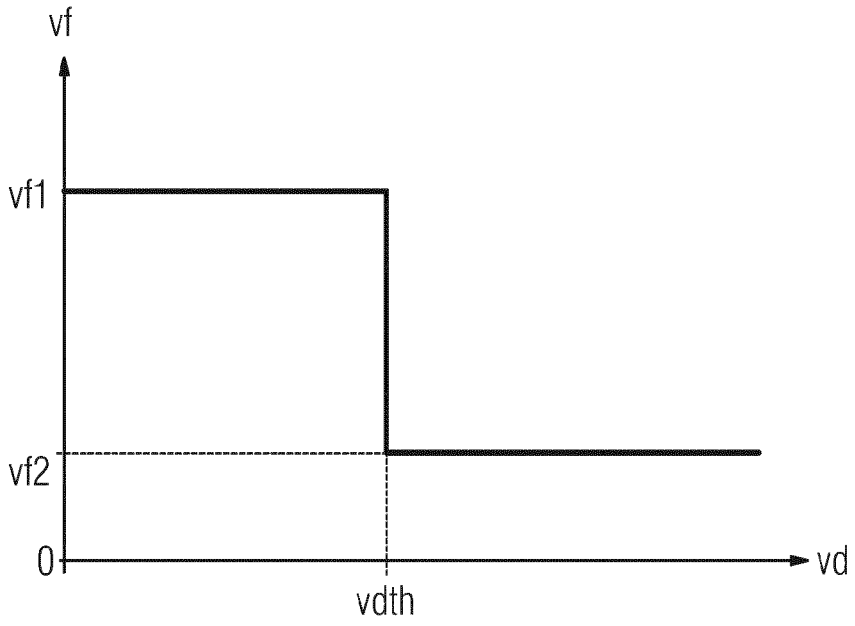
FIG. 7 illustrates a schematic diagram of a further example of the correlation between the fan rotation speed and the drum rotation speed according to the present invention.

FIG. 7 illustrates a schematic diagram of a further example of the correlation between the fan rotation speed vf and the drum rotation speed vd according to the present invention. In this example, the fan rotation speed vf may take either a first fan rotation speed value vf1 or a second fan rotation speed value vf2. The first fan rotation speed value vf1 is higher than the second fan rotation speed value vf2. A predetermined threshold value vdth of the drum rotation speed vd is defined. If the drum rotation speed vd is lower than the threshold value vdth, then the fan rotation speed vf takes the first fan rotation speed value vf1. If the drum rotation speed vd is higher than the threshold value vdth, then the fan rotation speed vf takes the second fan rotation speed value vf2.

Figure 8:
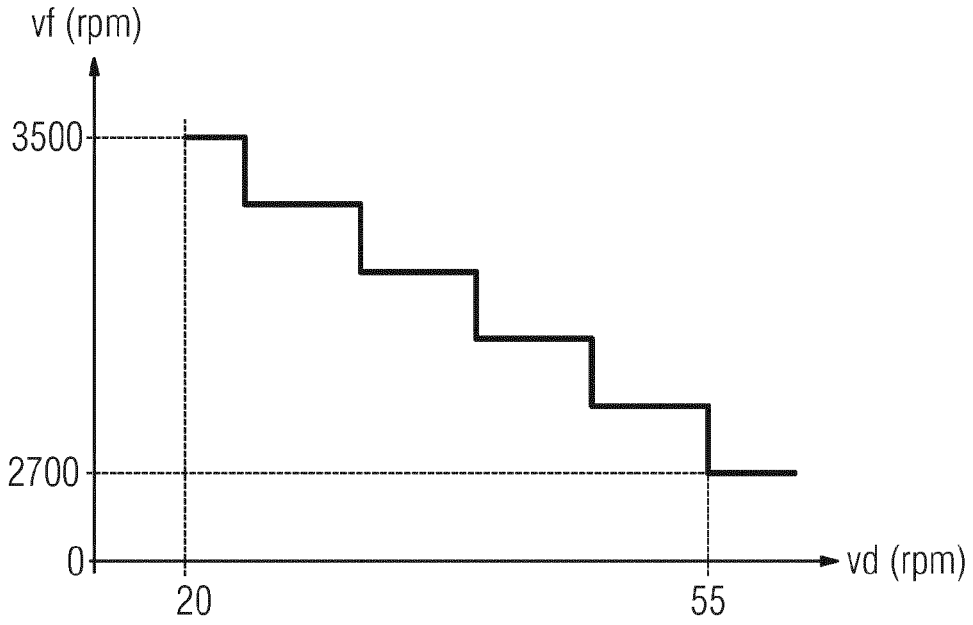
FIG. 8 illustrates a schematic diagram of another example of the correlation between the fan rotation speed and the drum rotation speed according to the present invention.

FIG. 8 illustrates a schematic diagram of another example of the correlation between the fan rotation speed vf and the drum rotation speed vd according to the present invention. The diagram in FIG. 8 is similar to the diagram in FIG. 3. However, the diagram in FIG. 3 in linear, while the diagram in FIG. 8 is staircase-shaped. The fan rotation speed vf in FIG. 8 can take a number of discrete fan rotation speed values.

Figure 9:
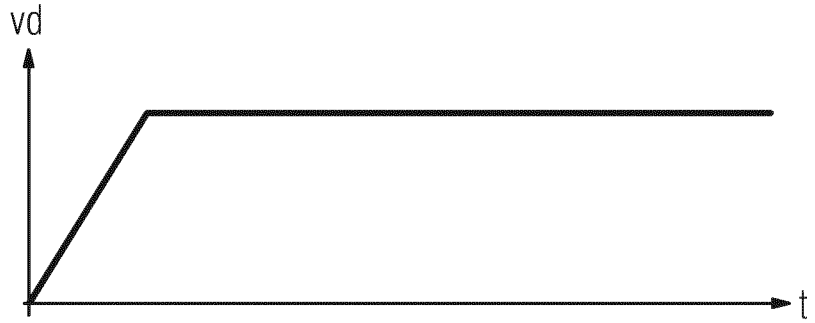
FIG. 9 illustrates a schematic diagram of the drum rotation speed as function of the time according to an example of the present invention.

FIG. 9 illustrates a schematic diagram of the drum rotation speed vd as function of the time according to an example of the present invention. In the beginning, the drum rotation speed vd increases linearly. Then, the drum rotation speed vd takes a constant steady state level.

The constant steady state level of the drum rotation speed is set according to a program selected by a user, and/or according to an input by the user, and/or according to an estimated/detected amount of laundry in the laundry drum.

Therefore different user selections or different laundry amount loaded inside the laundry drum lead to different constant steady state levels of the drum rotation speed. The fan rotation speed and/or the fan motor power of the drying air stream fan is adjusted accordingly.

Figure 10:
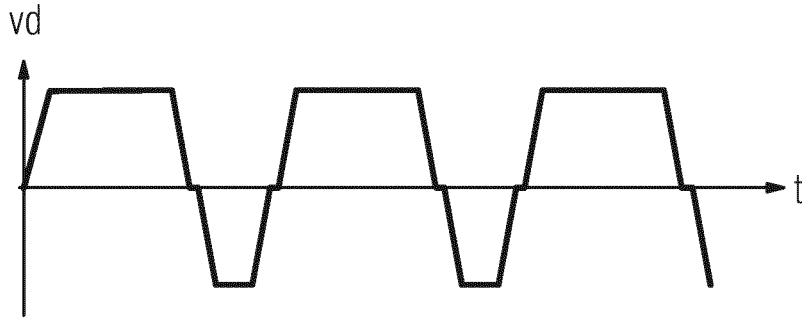
FIG. 10 illustrates a schematic diagram of the drum rotation speed as function of the time according to a further example of the present invention.

FIG. 10 illustrates a schematic diagram of the drum rotation speed vd as function of the time according to a further example of the present invention. In this example, the rotation direction of the laundry drum 12 is inverted periodically. The clock-wise and counter clock-wise rotation speed of the drum are set according to a program selected by a user, and/or according to an input by the user, and/or according to an estimated/detected amount of laundry in the laundry drum.

Therefore different user selections or different laundry amount loaded inside the laundry drum lead to different drum rotation speed patterns and the fan rotation speed and/or the fan motor power of the drying air stream fan is adjusted accordingly.

Figure 11:
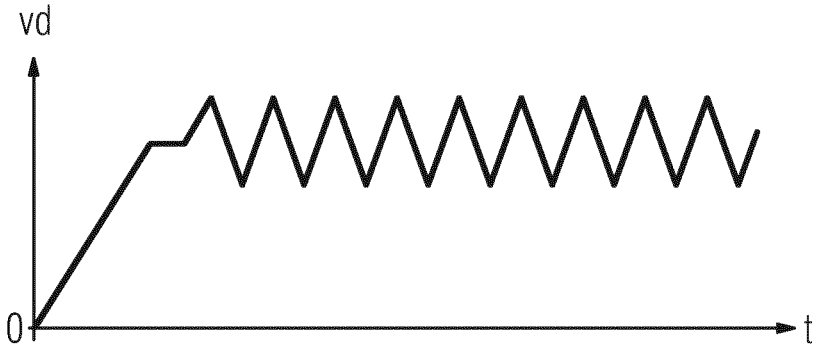
FIG. 11 illustrates a schematic diagram of the drum rotation speed as function of the time according to another example of the present invention.

FIG. 11 illustrates a schematic diagram of the drum rotation speed vd as function of the time according to another example of the present invention. In the beginning, the drum rotation speed vd increases linearly. Then, the drum rotation speed vd oscillates around an average value. The rotation speed pattern of the drum and the average value are set according to a program selected by a user, and/or according to an input by the user, and/or according to an estimated/detected amount of laundry in the laundry drum. Therefore different user selections or different laundry amount loaded inside the laundry drum lead to different drum rotation speed patterns average value and the fan rotation speed and/or the fan motor power of the drying air stream fan is adjusted accordingly.

The applicant has found that the efficiency of the heat pump system depends on the flow rate of the air stream in the air stream circuit 10. The flow rate of the air stream is set by the fan rotation speed vf. The higher is the flow rate of the air stream, the more efficient is the heat pump system. As such, it would be advantageous to push upwards the fan rotation speed vf when the drum rotation speed decreases. The higher energy consumption of the fan motor 26 in fact is more than compensated by the lower energy consumption of the compressor which works in a more favourable condition when the drying air stream increases.

Therefore, a proper increase of the fan rotation speed vf recovers the expected performances without exceeding the predetermined overall energy consumption.

The present invention is also expedient for a heat pump system having a variable speed compressor. In particular, the rotation speed or power of the compressor 22 is adjusted according to the fan rotation speed vf. The rotation speed or power of the compressor 22 increases, when the fan rotation speed vf increases.

In case of vented laundry dryers, a flow rate of the air stream allows a higher drying capacity, since the air of the air stream is discharged after it flows through the laundry drum 12 instead of being re-circulated. Moreover, the higher is the flow rate of the air of the air stream, the higher is the amount of heat adsorbed from the environment. This results in a drying time reduction and a higher efficiency.

Generally, it has been found that in laundry dryers where the drum rotation speed vd is modified according to some logic and/or parameters and/or amount of laundry loaded inside the laundry drum, the overall performances of the laundry dryer are greatly affected, and in particularly performances tend to decrease when drum rotation speed vd is lowered. Therefore, it is possible to increase the fan rotation speed vf in order to recover the expected efficiency of the laundry dryer without exceeding a predetermined energy consumption. In conclusion, an idea of the present invention is to regulate the fan rotation speed vf on the basis of the drum rotation speed vd according to an empirical relation. Said empirical relation depends on the characteristic of the machine and assures not to exceed the predetermined energy consumption whilst maintaining the drying efficiency of the laundry dryer.

Preferably the control unit is adapted to adjust the rotation speed of the laundry drum based on the laundry amount loaded inside the laundry drum. Preferably the drum rotation speed decreases when the laundry amount increases. The amount of load inside the laundry drum 12 may be detected by a detection device in or at said laundry drum 12. Preferably, electrodes can be provided to detect the electric resistance and/or conductivity of the laundry inside the drum. Noise and fluctuation of the electric signal associated to the detected electric resistance and/or conductivity of the laundry are used to estimate the laundry amount.

The amount of load in the laundry drum 12 may be further estimated by the temperature difference of the drying air stream between an inlet and outlet of the laundry drum 12. The temperature difference of the inlet and outlet of the laundry drum 12 is related to the amount of water extracted from the laundry and decreases in the case of a small heat exchange between the drying air stream and the laundry. In a similar way, the amount of load in the laundry drum 12 may be detected by the temperature difference of the drying air stream between an inlet and outlet of the air-to-air condenser 36 or the evaporator 14. This temperature difference is also related to the amount of water extracted from the laundry. However, the temperature difference between the inlet and outlet of the air-to-air condenser 36 or evaporator 14 increases in the case of a small heat exchange between the drying air stream and the laundry.

Further, an amount of load in the laundry drum 12 can be estimated by detecting an electric parameter of the laundry drum motor. Motor current, motor voltage, motor power provide vary in response to the laundry amount and an estimation of the laundry amount can be derived from said parameters when the drum rotates.

Also the torque of the laundry drum motor can be used to estimate the laundry amount.

A basic idea of the invention allows a way to maintain the power consumption of the fan motor 26 and drum motor 28 at low average level without penalising the drying performance of the machine. Particularly, aspects of the invention provides an accurate and efficient power balancing between the power absorbed by the fan motor 26 and by the drum motor 28. When the drum rotation speed vd and the drum motor power Pd are low, then the fan motor 26 and the drum motor 28 can be set to higher speed values and higher powers, so that the power saved at the drum motor 28 is transferred to the fan motor 26.

Further, in the case of a higher speed level of the fan motor 26, an increased flow rate and better performances follow. On the other hand, when the drum rotation speed vd and the drum motor power Pd are relatively high, then the fan rotation speed vf is set to a lower level in order to balance the relative high power consumption of the drum motor 28 and maintain globally a low power level. Since the fan rotation speed vf is in any case sufficiently high, the drying performances are maintained at a satisfactory level and the power consumption of the machine is kept within predetermined limits.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 air stream circuit
12 laundry drum
14 evaporator
16 condenser
18 drying air stream fan
20 refrigerant circuit
22 compressor
24 expansion device
26 fan motor
28 drum motor
30 control unit
32 fan control line
34 drum control line
36 air-to-air condenser
38 ambient air fan
vf fan rotation speed
vd drum rotation speed
Pf fan motor power
Pd drum motor power
vf1 first fan rotation speed value
vf2 second fan rotation speed value
vdth threshold value of the drum rotation speed

The invention claimed is:

1. A method for controlling a laundry dryer including a laundry drum with a variable drum rotation speed (vd) and a drying air stream fan with a variable fan rotation speed (vf), said method comprising the steps of:

setting a course of the drum rotation speed (vd) or a course of a drum motor power (Pd) of the laundry drum, and setting a fan rotation speed (vf) and/or a fan motor power (Pf) of the drying air stream fan on the basis of the drum rotation speed (vd) and/or the drum motor power (Pd) of the laundry drum, wherein the fan rotation speed (vf) and/or the fan motor power (Pf) of the drying air stream fan is decreased with an increasing drum rotation speed (vd) and/or increasing drum motor power (Pd) of the laundry drum, and wherein the fan rotation speed (vf) and/or the fan motor power (Pf) of the drying air stream fan is increased with a decreasing drum rotation speed (vd) and/or decreasing drum motor power (Pd) of the laundry drum.

2. The method according to claim 1, wherein the course of the drum rotation speed (vd) or the course of the drum motor power (Pd) of the laundry drum is set according to a program selected by a user, and/or according to an input by the user, and/or according to an estimated load in the laundry drum.

3. The method according to claim 1, wherein the fan rotation speed (vf) of the drying air stream fan decreases linearly with increasing drum rotation speed (vd) of the laundry drum.

4. The method according to claim 1, wherein the fan motor power (Pf) of the drying air stream fan decreases linearly with increasing drum motor power (Pd) of the laundry drum.

5. The method according to claim 1, wherein the fan rotation speed (vf) of the drying air stream fan decreases linearly with increasing drum motor power (Pd) of the laundry drum.

6. The method according to claim 1, wherein the fan motor power (Pf) of the drying air stream fan decreases linearly with increasing drum rotation speed (vd) of the laundry drum.

7. The method according claim 1, wherein a predetermined threshold value of the drum rotation speed is defined and if the drum rotation speed is lower than the threshold value, then the fan rotation speed is set to a first fan rotation speed value, and if the drum rotation speed is higher than the threshold value, then the fan rotation speed is set to a second fan rotation speed value, wherein the first fan rotation speed value is higher than the second fan rotation speed value.

8. The method according to claim 1, wherein the fan rotation speed (vf) of the drying air stream fan or the fan motor power (Pf) of the drying air stream fan decreases step-wise with increasing drum rotation speed (vd) of the laundry drum or with increasing drum motor power (Pd) of the laundry drum.

9. The method according to claim 1, wherein the method is provided for a laundry dryer with a heat pump system, and wherein a rotation speed and/or a power of a compressor is controlled in dependence of the fan rotation speed (vf) of the drying air stream fan.

10. The method according to claim 9, wherein the rotation speed or power of the compressor increases with increasing fan rotation speed (vf) of the drying air stream fan.

11. The method according to claim 1, wherein the drum rotation speed (vd) of the laundry drum is variable between 10 rpm and 70.

12. The method according to claim 1, wherein the fan rotation speed (vf) of the drying air stream fan is variable between 2000 rpm and 4000 rpm.

13. A laundry dryer including a laundry drum driven by a drum motor and a drying air stream fan driven by a fan motor, wherein the drum motor and the fan motor are controlled or controllable independently from each other by a control unit, and wherein the laundry dryer is configured to perform the method according to claim 1.

14. The laundry dryer according to claim 13, wherein the laundry dryer comprises a heat pump system having a compressor.

15. The laundry dryer according to claim 14, wherein a rotation speed and/or a power of a compressor is controlled or controllable by the control unit, preferably in dependence of the fan rotation speed (vf) of the drying air stream fan.

16. The method according to claim 11, wherein the drum rotation speed (vd) of the laundry drum is variable between 20 rpm and 60 rpm.

17. The method according to claim 12, whrein the fan rotation speed (vf) of the drying air stream fan is variable between 2700 rpm and 3500 rpm.

* * * * *